US007828862B2

(12) United States Patent
Leung

(10) Patent No.: US 7,828,862 B2
(45) Date of Patent: Nov. 9, 2010

(54) HIGHLY EFFECTIVE FUEL ADDITIVES FOR IGNITING INTERNAL COMBUSTION ENGINES, DIESEL ENGINES AND JET PROPULSION ENGINES

(75) Inventor: Wai Yin Leung, Hong Kong (HK)

(73) Assignee: Syn-Tech Fine Chemicals Company Limited, Tuen Mum (HK)

( * ) Notice: Subject to any disclaimer, the term of this patent is extended or adjusted under 35 U.S.C. 154(b) by 492 days.

(21) Appl. No.: 11/932,976

(22) Filed: Oct. 31, 2007

(65) Prior Publication Data

US 2009/0107035 A1 Apr. 30, 2009

(51) Int. Cl.
*C10L 1/18* (2006.01)

(52) U.S. Cl. ..... 44/439; 44/389; 44/443; 44/447

(58) Field of Classification Search ..... 44/389, 44/439, 443, 447
See application file for complete search history.

(56) References Cited

U.S. PATENT DOCUMENTS

| | | | | | |
|---|---|---|---|---|---|
| 1,587,899 | A | * | 6/1926 | Carroll et al. | 44/451 |
| 2,089,580 | A | | 8/1937 | Schulze | 44/9 |
| 2,104,021 | A | | 1/1938 | Callis | 44/9 |
| 2,221,839 | A | | 11/1940 | Lipkin | 44/9 |
| 2,402,863 | A | | 6/1946 | Zuidema et al. | 44/62 |
| 2,563,101 | A | | 8/1951 | Colwell et al. | |
| 2,786,745 | A | | 3/1957 | Stayner et al. | 52/5 |
| 2,930,681 | A | | 3/1960 | Barusch | 44/74 |
| 3,032,971 | A | | 5/1962 | Shotton | 60/35.4 |
| 3,103,101 | A | | 9/1963 | Jaffer, Jr. | 60/35.4 |
| 3,270,497 | A | | 9/1966 | Malick | 60/35.4 |
| 4,131,434 | A | * | 12/1978 | Gonzalez | 44/413 |
| 4,818,250 | A | | 4/1989 | Whitworth | 44/62 |
| 5,425,790 | A | | 6/1995 | Liotta, Jr. et al. | 44/443 |
| 5,514,190 | A | | 5/1996 | Cunningham et al. | 44/415 |
| 5,697,988 | A | | 12/1997 | Malfer et al. | 44/415 |
| 5,873,917 | A | | 2/1999 | Daly | 44/443 |
| 5,912,189 | A | | 6/1999 | Wolak et al. | 44/329 |

FOREIGN PATENT DOCUMENTS

| | | | |
|---|---|---|---|
| JP | 07207248 | * | 8/1995 |

OTHER PUBLICATIONS

Louis Lapointe, "Acetone in Fuels" Copy right 1990-2007 publish on SmartGas.net www.lubedev.com/smartgas/additive.htm.

* cited by examiner

*Primary Examiner*—Cephia D Toomer
(74) *Attorney, Agent, or Firm*—J.C. Patents

(57) ABSTRACT

The fuel additives of the present invention comprise essentially of about 10-50 weight % of terpene, 0-15 weight % of Alkylene Glycol Ether, and 40-80 weight % of 2-Propanone, 0-20 weight % of Dibasic Methyl Ester and 0-15 weight % of nonyl phenol ethoxylate and 0-15 weight % of mineral oil. This highly effective fuel additives can eliminate the formation of deposits and form air-borne micro-cluster molecules in internal combustion engines, particularly, in the fuel injection system and combustion chamber of such engines.

15 Claims, No Drawings

HIGHLY EFFECTIVE FUEL ADDITIVES FOR IGNITING INTERNAL COMBUSTION ENGINES, DIESEL ENGINES AND JET PROPULSION ENGINES

BACKGROUND OF THE INVENTION

1. Field of the Invention

The present invention is related to novel engine fuel additives which are more efficient and environmentally safer than the relatively higher boiling naphtha and/or naphthalene containing engine fuel additive products. The inventive fuel compositions are suitable for igniting internal combustion engines and diesel engines, as well as jet propulsion engines.

2. Description of the Prior Art

The performance of an internal combustion engine may be adversely affected by the formation of deposits in or around the fuel injection system and combustion chamber. Even when present in minor amounts, these deposits, resulted from incomplete combustion, can cause a noticeable reduction in the performance of the engine, an increase in fuel consumption, and the production of exhaust pollutants. It is generally accepted that deposit formation is largely dependent on the fuel composition, and to a lesser extent, on the engine design and on the operating conditions of the engine. In an effort to control deposit formation, considerable efforts have been directed toward developing fuel additives that could facilitate the complete combustion of fuel, thereby reduced the tendency to cause the formation of deposits. In particular, the majority of the research has been directed toward developing fuel additives that either prevent or reduce the formation of such deposits.

For example, it has been proposed to employ various alkyl ethers, as fuel additive, for the purpose of dissolving deposits generated by gasoline fuels. Such attempts are described in U.S. Pat. Nos. 2,089,580, 2,104,021, 2,221,839, 2,563,101, 2,786,745, 2,930,681, 3,032,971, 3,103,101, 3,270,497, and 5,425,790 as representative. As described in those patents, it is frequently the practice to employ such ethers either alone or in combination with alcohol to provide improved performance characteristics in a variety of liquid hydrocarbon fuels.

U.S. Pat. No. 5,912,189 discloses compositions that are useful as fuel additives for reducing intake valve deposits. Such compositions comprise the reaction product of: (a) a cyclic compound containing at least one nitrogen and at least one carbonyl group; (b) an aldehyde or ketone; and (c) an etheramine.

U.S. Pat. No. 5,873,917 discloses compositions that are useful in reducing intake valve deposits. Such compositions contain: (a) a polyether alcohol; (b) a hydrocarbonphenol; and (c) optionally, a nitrogen-containing dispersant.

U.S. Pat. No. 5,514,190 discloses fuel additive compositions for controlling intake valve deposits. These compositions comprise: (a) a gasoline-soluble Mannich reaction product of a high molecular weight alkyl-substituted phenol, an amine, and an aldehyde; (b) a gasoline-soluble poly(oxyalkylene) carbamate; and (c) a gasoline-soluble poly(oxyalkylene) alcohol, glycol, or polyol, or mono or diether thereof.

U.S. Pat. No. 5,697,988 discloses a fuel additive composition that reduces engine deposits and controls octane requirement increases in engines. The fuel additive composition comprises: (a) a Mannich reaction product of a high molecular weight alkyl-substituted phenol, an amine, and an aldehyde; (b) a polyoxyalkylene compound; and (c) optionally, a poly-.varies.-olefin.

U.S. Pat. No. 4,818,250 further discloses other alternatives to conventional fuels, including U.S. Pat. No. 4,131,434 to Gonzalez, which is directed to a fuel additive for oil, diesel oil, and gasoline to improve fuel efficiency and reduce resulting air pollutants. Exemplary Gonzalez additives are aromatic and aliphatic hydrocarbon solvents with and without oxygenated functional groups, terpenes, and aromatic nitrogen containing compounds.

U.S. Pat. No. 2,402,863 to Zuidema et al., which is also discussed in the Whitworth patent, is directed to blended gasoline of improved stability and, more particularly, leaded gasoline containing up to about 10% alicyclic olefins which preferably contain a cyclohexane ring. Cyclic olefin is defined as an alicyclic hydrocarbon containing an olefin double bond in the ring (preferably no more than one). The alicyclic olefins are suggested to be available from terpenes or from synthesis such as partial dehydrogenation of naphthenes. A number of individual cyclic olefins are stated as being suitable, including, for example, terpenes such a dilimonene (citene) and D-limonene (dipentene).

In an article, "Acetone in Fuels", published by SmartGas (Jul. 29, 2006), Louis LaPointe stated the presence of acetone in the fuel could cause the fuel to burn better. Acetone survives the heat of combustion for a very long time although it vaporizes readily. While it burns slowly, its fierce vibrations break apart the massive fuel fragments that surround it. So, acetone encourages greater vaporization, thus leads to a much better mileage. LaPointe further concluded that acetone and ortho-xylene not only improve mileage, but also cut pollution dramatically and give longer life to engines.

Despite such efforts, further improvements in the art are needed. Specifically, what are needed are fuel additives that function as fuel surface tension softener that lubricates the parts, as well as prevents or reduces deposit formation in the port fuel injected internal combustion engines. Fuel compositions containing such fuel additives also facilitate a full combustion within the combustion cycle, therefore reduces toxic emissions, such as carbon monoxide and nitrogen oxides.

SUMMARY OF THE INVENTION

The present invention provides a fuel additive composition for use in internal combustion engines comprising:

(a) about 10 to 50 Wt % of Terpene (b) about 0 to 15 Wt % of Alkylene Glycol Ether (c) about 40 to 80 Wt % of 2-Propanone (d) about 0 to 20 Wt % of Dibasic Methyl Esters (e) about 0 to 15 Wt % of Nonyl Phenol Ethoxylate (f) about 0 to 15 Wt % of Mineral Oil.

The present invention also provides a fuel composition comprising the additive above. The additive can be used for both gasoline and diesel fuels. Such fuel additive compositions are particularly suited for controlling fuel injection system deposits in engines, and are expected to reduce combustion chamber deposits in such engines. The present invention additionally provides for a method for controlling the formation of toxic incomplete gas emissions, such as: carbon monoxide and/or nitrogen oxides, and particularly, in the fuel injection system and combustion chamber of such engines. The method involves fueling and operating such engines with this fuel additive invention comprising D-limonene, 2-popanone, diethylene glycol mono methyl ether, dibasic acid methyl esters, nonyl phenol ethoxylate and mineral oil as the main ingredients.

DESCRIPTION OF THE PREFERRED EMBODIMENT

The present invention is directed to fuel additives for igniting engines, including internal combustion engines and diesel engines as well as jet propulsion engines. The characteristics of the inventive fuel additive include greater efficiency in terms of gallons per hour (GPH), improved safety due to a lower vapor pressure, cleaner burning resulting in fewer emissions and particulates being released into the atmosphere, and cooler burning engines.

The preferred terpene is limonene which is a naturally occurring chemical found in high concentrations in citrus fruits and spices. For ease of explanation, the present inventive fuel compositions (and fuel additive formulations) will be discussed herein with reference to limonene as the terpene fuel component. However, it is recognized that other suitable terpenes may be used, as well. While D-limonene is the more preferred isomer, L-limonene may also be used in the present invention (L-limonene is also found in naturally occurring substances such as pine-needle oil, oil of fir, spearmint, and peppermint, for example). In addition to uses as flavor additives and perfume materials, limonene has been used in household and industrial cleaning products. Limonene is commercially available from Florida Chemical Company, Inc., for example, in three different grades, namely untreated/technical grade, food grade, and lemon-lime grade. The food grade comprises about 97% D-limonene, the untreated/technical grade about 95% D-limonene, and the lemon-lime grade about 70% D-limonene, the balance in all being other terpene hydrocarbons and oxygenated compounds. The technical and food grades of limonene are the most preferred for use in this invention and require no additional purification to remove impurities or water.

Depending upon the particular components present and the type of engine for which it is formulated, the inventive fuels preferably comprise from about 10 wt % to about 50 wt % D-limonene, more preferably from about 15 wt % to about 30 wt %, at least 10 w/w % should be present if the fuel contains no lubricating oil. However, if the fuel comprises lower concentrations of D-limonene of less than about 10 wt %, the fuel should further comprise a sufficient amount of at least one lubricating oils, namely 0-15 wt % of mineral oil and or 0-15 wt % of nonyl phenol ethoxylate.

Limonene has a flash point ranging from about 45° C. to about 51° C., depending on the purity of the material. Due to its high flash point, limonene alone will not easily ignite an engine unless subjected to a very high temperature spark resulting from high voltage ignitions which are commonly present in large 4-cycle. The inventive fuels, however, should preferably have flash points ranging from about 7° C. to about 24° C., in order to ignite the engine.

The additive of the present invention can comprise an organic solvent as a flash-point lowering compound, more preferably short-chain carbonyl compound (such as ketone) having a relatively low boiling point, around 50-60° C. The most preferred short-chain carbonyl compound is 2-propanone, which could emit relatively few volatile organic compounds (VOC) when burned, blends well with limonene and the other components of the fuel, and is inexpensive.

In the additive of the present invention, other hydrocarbon solvent may also be used, preferably mineral oil, having flash point of 200° C. with lubricating function, in order to lubricate the engine. The concentration of mineral oil is preferably about 0 to 15 Wt %, more preferably about 3 to 15 Wt %, most preferably about 3 to 8 Wt %.

Certain embodiments of the inventive fuel additive compositions also contain at least one nonyl phenol ethoxylate. A sufficient amount of at least one nonyl phenol ethoxylate is often required when more than 10 wt % of limonene is present in the fuel additive composition. Nonyl phenol ethoxylate is often desirable since it allows the fuel components to blend better by lowering surface tension of the mixture, thereby increasing the number of micro-cluster in fuel mixture. The concentration of nonyl phenol ethoxylate is preferably about 0 to 15 Wt %, more preferably about 3 to 15 Wt %, most preferably about 3 to 8 Wt %.

The types of alkylene glycol ethers that can be used in the present invention are commonly known to possess higher BTU's. The most preferred alkylene glycol ether is diethylene glycol mono methyl ether (also known as DEGME) because it has a unique property of locking up to 100% by its weight of water molecule. Examples of other suitable alkylene glycol ethers include, but are not limited to, propylene glycol ter-butyl ether (i.e. glycol ether PTB), ethylene glycol mono methyl ether (i.e. glycol ether EM), ethylene glycol mono ethyl ether (i.e. glycol ether EE), 2-(2-methoxyethoxy) ethanol (i.e. glycol ether DM), diethylene glycol mono ethyl ether (i.e. glycol ether DE) and hexyl carbitol. The concentration of the alkylene glycol ether is preferably about 0-15 wt % more preferably about 0-8 wt %, most preferably about 0-5 Wt %.

The types of dibasic acid methyl esters that can be used in the present invention include, but are not limited to, adipic acid methyl ester, glutaric acid methyl ester and succinic acid methyl ester and a mixture thereof. The concentration of the dibasic acid methyl esters is about 0-20 wt %, more preferably about 0-10 wt %, most preferably about 0-5 wt %.

All of the above inventive fuel additives are suitable for conventional petroleum-based engine fuels, preferably gasoline having an octane number of at least 87, and diesel fuels engines. A preferred fuel additive formulation comprises from about 10 to about 30 wt % limonene, more preferably about 10 to 25 wt %, most preferably about 10 to 15 wt % of D-limonene. The preferred fuel additive invention also comprises from about 40 to 80 wt % of 2-propanone, more preferably about 60 to 70 wt %. The preferred fuel additive invention comprises from about most preferably about 3-8 wt % of Nonyl Phenol Ethoxylate. The preferred fuel additive invention further comprises about 3-8 wt % of Mineral Oil. The preferred fuel additive invention further comprises about 0-5 wt % alkylene glycol ether. The preferred fuel additive invention further comprises about 0-5 wt % of dibasic methyl esters.

The fuel additives of the present invention can be blended with either gasoline or diesel fuel as needed for different types of engines. The said fuel additive is added in an amount sufficient to produce a fuel additive: gasoline fuel (or diesel fuel) volume ratio of greater than about 1:1000, preferably between about 1:1000 and 1:640.

The concepts of the present invention reside in a novel fuel additives which are not only simple and inexpensive to manufacture, but also have the capability of enhancing the performance characteristics of both gasoline and diesel fuels, such that the treated gasoline/diesel fuels, when consumed in an internal combustion engine, burn far more efficiently with substantially less emissions. It has been found that the treated fuel according to the present invention provides not only greater fuel mileage but also provides increase horsepower realization. In accordance with the concepts of the invention, the fuel additives are formulated with a novel combination of components, which function together to significantly reduce hydrocarbon emissions in the burning of gasoline/diesel fuel to which the additive has been combined in internal combustion engines.

Accordingly, the present invention includes novel fuel additives that control the formation of deposits in engines. Such fuel additive compositions are particularly suited for controlling fuel injection system deposits in engines, and are expected to reduce combustion chamber deposits in such engines. The fuel additives of the present invention also function as fuel surface tension reducing agent to reduce the surface tension of the fuel.

The fuel additives of the present invention comprise D-limonene, 2-propanone, nonyl phenol ethoxylate, alkylene glycol ether (Diethylene Glycol Mono Methyl Ether), dibasic methyl esters/or mineral oil. The presence of 2-propanone appears to improve oxidation efficiency of the fuel with which the additive is combined and the nonyl phenol ethoxylate, the glycol ether or the dibasic esters appear to offer both lubricity and formation of micro-cluster molecule within the fuel system containing the additive so as to facilitate the complete combustion of the treated fuel.

The fuel additives of the present invention can be blended with either gasoline or diesel fuel as needed for different types of engines. The said inventive fuel additives can also be mixed with gasoline or diesel fuel, in the respective ratios from 1:1000.

According to the present invention, the characteristics of the inventive fuel additive include greater efficiency in terms of gallons per hour (GPH), improved safety due to a lower vapor pressure, cleaner burning resulting in fewer emissions and particulates being released into the atmosphere, and cooler burning engines.

The following formulations are not intended to limit the scope of the invention, but are intended to illustrate the various aspects of the invention.

Formulation 1:

| | |
|---|---|
| 1. D-Limonene | 20 Wt % |
| 2. Alkylene Glycol Ether | 0 Wt % |
| 3. 2-Propanone | 70 Wt % |
| 4. Dibasic methyl esters | 0 Wt % |
| 5. Nonyl Phenol Ethoxylate | 5 Wt % |
| 6. Mineral Oil | 5 Wt % |

Formulation 2:

| | |
|---|---|
| 1. D-Limonene | 19 Wt % |
| 2. Alkylene Glycol Ether | 0 Wt % |
| 3. 2-Propanone | 68 Wt % |
| 4. Dibasic methyl esters | 0 Wt % |
| 5. Nonyl Phenol Ethoxylate | 8 Wt % |
| 6. Mineral Oil | 5 Wt % |

Formulation 3:

| | |
|---|---|
| 1. D-Limonene | 12 Wt % |
| 2. Alkylene Glycol Ether | 10 Wt % |
| 3. 2-Propanone | 68 Wt % |
| 4. Dibasic Methyl Esters | 10 Wt % |
| 5. Nonyl Phenol Ethoxylate | 0 Wt % |
| 6. Mineral Oil | 0 Wt % |

Formulation 4:

| | |
|---|---|
| 1. D-Limonene | 12 Wt % |
| 2. Alkylene Glycol Ether | 10 Wt % |
| 3. 2-Propanone | 68 Wt % |
| 4. Dibasic Methyl Esters | 5 Wt % |
| 5. Nonyl Phenol Ethoxylate | 0 Wt % |
| 6. Mineral Oil | 5 Wt % |

Formulation 5:

| | |
|---|---|
| 1. D-Limonene | 22 Wt % |
| 2. Alkylene Glycol Ether | 5 Wt % |
| 3. 2-Propanone | 68 Wt % |
| 4. Dibasic Methyl Esters | 5 Wt % |
| 5. Nonyl Phenol Ethoxylate | 0 Wt % |
| 6. Mineral Oil | 0 Wt % |

Formulation 6:

| | |
|---|---|
| 1. D-Limonene | 22 Wt % |
| 2. Alkylene Glycol Ether | 5 Wt % |
| 3. 2-Propanone | 68 Wt % |
| 4. Dibasic methyl esters | 0 Wt % |
| 5. Nonyl Phenol Ethoxylate | 0 Wt % |
| 6. Mineral Oil | 5 Wt % |

Source of Chemical Supplier:

| | |
|---|---|
| D-Limonene [Trade name, d-Limonene] | Florida Chemical Company Inc. |
| Propylene Glycol ter-Butyl Ether [Trade name, ARCOSOLV PTB] | Lyondell Chemical Company |
| Diethylene Glycol mono-Methyl Ether [Trade name, Glycol Ether DM] | Lyondell Chemical Company |
| 2-Propanone [Trade name, Acetone] | Shell Chemicals Ltd. |
| Dibasic methyl esters [Trade name, DBE] | INVISTA |
| Nonyl Phenol Ethoxylate [Trade name, Igepal CO630] | Stepan Company |
| Mineral Oil [Trade name, Mineral Oil] | Shell Chemicals Ltd. |

Preparation of Formula 1: 20 Wt % D-Limonene, 70 Wt % 2-Propanone, and 5 Wt % of Nonyl Phenol Ethoxylate and 5 Wt % of Mineral Oil were respectively added to form the homogeneous Formulation 1.

Preparation of Formula 2: 19 Wt % D-Limonene, 68 Wt % 2-Propanone, and 8 Wt % of Nonyl Phenol Ethoxylate and 5 Wt % of Mineral Oil were respectively added to form the homogeneous Formulation 2.

Preparation of Formula 3: 12 Wt % D-Limonene, 10 Wt % of Propylene Glycol ter-Butyl Ether (or Diethylene Glycol mono-Methyl Ether), 68 Wt % 2-Propanone and 10 Wt % of Dibasic Methyl Esters were respectively added to form the homogeneous Formulation 3.

Preparation of Formula 4: 12 Wt % D-Limonene, 10 Wt % of Propylene Glycol ter-Butyl Ether (or Diethylene Glycol mono-Methyl Ether), 68 Wt % 2-Propanone, 5 Wt % of Dibasic Methyl Esters and 5 Wt % Mineral Oil were respectively added to form the homogeneous Formulation 4.

Preparation of Formula 5: 22 Wt % D-Limonene, 5 Wt % of Propylene Glycol ter-Butyl Ether (or Diethylene Glycol mono-Methyl Ether), 68 Wt % 2-Propanone, 5 Wt % of Dibasic Methyl Esters were respectively added to form the homogeneous Formulation 5.

Preparation of Formula 6: 22 Wt % D-Limonene, 5 Wt % of Propylene Glycol ter-Butyl Ether (or Diethylene Glycol mono-Methyl Ether), 68 Wt % 2-Propanone and 5 Wt % Mineral Oil were respectively added to form the homogeneous Formulation 6.

Experiment One

Studies were conducted on the Mercury Villager 1995 engine. A ratio of 1/1000, fuel additive/gasoline (v/v), was employed to be tested at the mentioned gasoline engine, which proportion was considered to be the most effective dose.

The vehicle's engine was allowed to run using each of the fuel additives (Formulations 1-6) mixed respectively with gasoline (octane number=97) in a ratio of 1 part of fuel additive to 1000 parts of gasoline. Data, as Fuel Economy (Liter/100 Km), were recorded when the vehicle was running consistently at exactly 50 Km/hour, see Table 1 below:

TABLE 1

| | (1) | (2) | (3) | (4) | (5) | (6) | Fuel with Octane No. = 97 |
|---|---|---|---|---|---|---|---|
| Fuel Economy, Litre/100 Km | 6 | 6 | 6 | 6 | 6 | 6 | 9 |

Notes:
in Formulations 3-6, the same results were obtained when 10 Wt % of Propylene Glycol ter-Butyl Ether was replaced with 10% Diethylene Glycol mono-Methyl Ether.

Formulations (1) to (6) gave the most performable mileage result 6 Liter/100 Km, The tests were compared with the gasoline (Octane Number=97) as the Control Sample, which gave 9 Liter/100 Km. It was also noted that during ignition the vehicle started with shorter delay time and the engine became quieter and less vibration observed.

Experiment Two

Diesel was tested with or without the additive of Formulation 1 at a ratio of 1.3/1000 (v/v), according to the tests methods stipulated. The results are showed in Tables 2 and 3.

TABLE 2 test results with additive of Formulation 1

| TEST | METHOD | UNIT | SPECIFICATION | RESULT |
|---|---|---|---|---|
| Gross Heat of Combustion | ASTM D240-02 | BTU/lb | Report | 19679 |
| Copper Strip Corrosion | ASTM D130-04 | | Report | 1A |
| Cetane Number | ASTM D613-01 | | Report | 56.6 |
| Micro Carbon Residue on 10% Bottoms | ASTM D4530-06 | wt % | Report | <0.1 |

Remarks:
MCR 10% (Micro Carbon Residue on 10% Bottoms) = 0.033

TABLE 3 test results without additive of Formulation 1

| TEST | METHOD | UNIT | SPECIFICATION | RESULT |
|---|---|---|---|---|
| Gross Heat of Combustion | ASTM D240-02 | BTU/lb | Report | 19603 |
| Copper Strip Corrosion | ASTM D130-04 | | Report | 1A |
| Cetane Number | ASTM D613-01 | | Report | 56.3 |
| Micro Carbon Residue on 10% Bottoms | ASTM D4530-06 | wt % | Report | <0.1 |

Remarks:
MCR 10% (Micro Carbon Residue on 10% Bottoms) = 0.025

From the above test results, it is obvious that the Gross Heat of Combustion of the diesel with the additive of the present invention could be increased, comparing to the diesel without the additive of the present invention, which indicates that the combustion efficiency of the diesel with the additive could be improved. Meanwhile, the Cetane Number of the diesel with the additive of the present invention could also be increased, which means the diesel with the additive has shorter ignition delay periods than the diesel without the additive.

Experiment Three

Diesel was tested with the additive of Formulation 1 at a ratio of 1/1000 (v/v) in terms of the exhaust emission.

Equipment and Conditions Used:

1. Details of diesel engine
   Engine Manufacturer: ISUZU (Japan)
   Engine capacity: 4334 c.c.
   Model no.: 4HFI
   Compression ratio: 19:1
   No. of Cylinder: 4
2. Details of Eddy Current Dynamometer:
   Manufacturer: ONO Sokki (Japan)
   Rated Capacity: 150 kw
   Rated Torque: 455 Nm/900-3150 rpm
   Max. Revolution: 10000 rpm
3. Model DX 210 Smokemeter (made in UK)
4. The test is carried out at the Ambient Temperature 27° C.

Procedure of Test

Set up the base data before adding the additive. After adding additive, mix-up with diesel fuel to warm up the engine for two hours before conduct the test. In experiment, the result was obtained in Table 4 as follows:

| Engine Speed (rpm) | Without GO-2802 Smoke (HSU) | With GO-2802 Smoke (HSU) | Emission Change (%) |
|---|---|---|---|
| 1500 | 11.6 | 5.3 | −54.3 |
| 2000 | 12.5 | 7.6 | −39.2 |
| 2500 | 23.5 | 14.4 | −38.7 |
| 3000 | 45.2 | 36.5 | −19.2 |

Remarks:
GO-2802 refers to additive of Formulation 1.

After used "GO-2802 diesel additive", the exhaust gas quality was improved from 19.2% to 54.3% and reduce air pollution.

The fuel additives of the present invention can be blended with either gasoline or diesel fuel as needed for different types of engines. The said inventive fuel additives can also be mixed with gasoline or diesel fuel, in the respective ratios from 1:1000.

According to the present invention, the characteristics of the inventive fuel additive include greater efficiency in terms of gallons per hour (GPH), improved safety due to a lower vapor pressure, cleaner burning resulting in fewer emissions and particulates being released into the atmosphere, and cooler burning engines.

In this respect, before explaining the preferred examples of the invention in detail, it is to be understood that the invention is not limited in its application to the details of the fuel additive. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclose is based, may readily be utilized as a basis for designing other chemical compositions, formulae and fuels for carrying out the several purposes of the present invention. And the abstract of the present invention is just an abstract, not intended to be limiting as to the scope of the invention in any way.

I claim:

1. A fuel additive composition for use in internal combustion engines comprising:
(a) about 10 to 50 Wt % of terpene
(b) about 0 to 15 Wt % of alkylene glycol ether
(c) about 40 to 80 Wt % of 2-propanone
(d) about 0 to 20 Wt % of Dibasic Methyl Esters
(e) about 1 to 15 Wt % of Nonyl Phenol Ethoxylate
(f) about 0 to 15 Wt % of Mineral Oil.

2. The composition according to claim 1 comprising:
(a) about 10 to 30 Wt % of limonene
(b) about 0 to 10 Wt % of alkylene glycol ether
(c) about 50 to 80 Wt % of 2-propanone
(d) about 0 to 8 Wt % of Dibasic Methyl Esters
(e) about 1 to 8 Wt % of Nonyl Phenol Ethoxylate
(f) about 3 to 15 Wt % of Mineral Oil.

3. The composition according to claim 1 comprising:
(a) about 10 to 25 Wt % of D-limonene
(b) about 0 to 8 Wt % of alkylene glycol ether
(c) about 60 to 70 Wt % of 2-propanone
(d) about 0 to 5 Wt % of Dibasic Methyl Esters
(e) about 2 to 8 Wt % of Nonyl Phenol Ethoxylate
(f) about 3 to 8 Wt % of Mineral Oil.

4. The composition according to claim 3 comprising:
(a) about 10 to 15 Wt % of D-limonene
(b) about 0 to 5 Wt % of alkylene glycol ether
(c) about 60 to 68 Wt % of 2-propanone
(d) about 8 to 15 Wt % of Dibasic Methyl Esters
(e) about 10 to 15 Wt % of Nonyl Phenol Ethoxylate
(f) about 4 to 8 Wt % of Mineral Oil.

5. The composition according to claim 1 wherein which said alkylene glycol ether is selected from the group consisting of diethylene glycol mono methyl ether, propylene glycol ter-butyl ether, ethylene glycol mono methyl ether, ethylene glycol mono ethyl ether, 2-(2-methoxyethoxy)ethanol, diethylene glycol mono ethyl ether, hexyl carbitol or a mixture thereof.

6. The environmental friendly fuel additive of claim 1 wherein said alkylene glycol ether is selected from the group consisting of diethylene glycol mono methyl ether, ethylene glycol mono methyl ether, ethylene glycol mono ethyl ether, or a mixture thereof.

7. The environmental friendly fuel additive of claim 1 wherein said Dibasic Methyl Ester is selected from the group consisting of adipic acid ester, glutaric acid ester, succinic acid ester or a mixture thereof.

8. The fuel additive of claim 1 wherein said alkylene glycol ether includes propylene glycol ter-butyl ether.

9. The fuel additive of claim 1 wherein said alkylene glycol ether includes diethylene glycol mono-methyl ether.

10. The fuel additive of claim 1 in which said fuel additive composition has about 10 to 30 Wt % of D-limonene.

11. The fuel additive according to claim 5 in which said alkylene glycol ether is selected from the group consisting of propylene glycol ter-butyl ether, diethylene glycol mono-methyl ether or hexyl carbitol.

12. A gasoline fuel composition comprising gasoline fuel and fuel additive in a ratio of fuel additive:gasoline fuel volume ratio of greater than about 1:1000,
wherein the fuel additive comprises:
(a) about 10 to 50 Wt % of terpene
(b) about 0 to 15 Wt % of alkylene glycol ether
(c) about 40 to 80 Wt % of 2-propanone
(d) about 0 to 20 Wt % of Dibasic Methyl Esters
(e) about 0 to 15 Wt % of Nonyl Phenol Ethoxylate
(f) about 0 to 15 Wt % of Mineral Oil.

13. The gasoline fuel composition according to claim 12 wherein said fuel additive is added in an amount sufficient to produce a fuel additive:gasoline fuel volume ratio of between about 1:1000 and 1:640.

14. A diesel fuel composition comprising diesel fuel and fuel additive in a ratio of fuel additive:diesel fuel volume ratio of greater than about 1:1000,
wherein the fuel additive comprises:
(a) about 10 to 50 Wt % of terpene
(b) about 0 to 15 Wt % of alkylene glycol ether
(c) about 40 to 80 Wt % of 2-propanone
(d) about 0 to 20 Wt % of Dibasic Methyl Esters
(e) about 0 to 15 Wt % of Nonyl Phenol Ethoxylate
(f) about 0 to 15 Wt % of Mineral Oil.

15. The composition according to claim 14 in which said fuel additive is added in an amount sufficient to produce a fuel additive:diesel fuel volume ratio of between about 1:1000 and 1:640.

* * * * *